US007087146B2

(12) United States Patent
Grosse-Brinkhaus et al.

(10) Patent No.: US 7,087,146 B2
(45) Date of Patent: Aug. 8, 2006

(54) METHOD FOR PRODUCING A MULTILAYER COATING AND THE USE THEREOF

(76) Inventors: Karl-Heinz Grosse-Brinkhaus, Hagenstr. 90, 48301 Nottuln (DE); Georg Wigger, Schlossfeld 80, 48308 Senden (DE)

( * ) Notice: Subject to any disclaimer, the term of this patent is extended or adjusted under 35 U.S.C. 154(b) by 439 days.

(21) Appl. No.: 10/381,534

(22) PCT Filed: Oct. 19, 2001

(86) PCT No.: PCT/EP01/12102

§ 371 (c)(1),
(2), (4) Date: Mar. 26, 2003

(87) PCT Pub. No.: WO02/34418

PCT Pub. Date: May 2, 2002

(65) Prior Publication Data

US 2004/0094425 A1 May 20, 2004

(30) Foreign Application Priority Data

Oct. 23, 2000 (DE) ..... 100 52 438

(51) Int. Cl.
*C25D 13/12* (2006.01)

(52) U.S. Cl. ..... 204/488; 204/505

(58) Field of Classification Search ..... 204/486, 204/488, 484, 505; 205/317
See application file for complete search history.

(56) References Cited

U.S. PATENT DOCUMENTS

| | | | | |
|---|---|---|---|---|
| 3,998,716 | A | 12/1976 | Masar et al. | 204/181 |
| 4,375,498 | A | 3/1983 | Le Minez et al. | 428/416 |
| 5,229,210 | A | 7/1993 | Kasukaea et al. | 428/416 |
| 5,376,457 | A | 12/1994 | Smith | 428/457 |
| 5,389,406 | A | 2/1995 | Doebler et al. | 427/407.1 |
| 5,507,928 | A | 4/1996 | Böhmert et al. | 204/488 |
| 5,869,198 | A | 2/1999 | Erne et al. | 428/626 |
| 6,221,949 | B1 | 4/2001 | Gross et al. | 524/451 |

FOREIGN PATENT DOCUMENTS

| | | |
|---|---|---|
| DE | 44 09 715 | 9/1995 |
| WO | WO 96/30131 | 10/1996 |
| WO | WO 01/48097 | 7/2001 |

OTHER PUBLICATIONS

T. Dirking, K.H., entitled "Rheological characterization of electrodeposition coating materials during the baking procedure": correlation of viscosity values with edge protection results, atipec XXIII, 1996, Brussels, Belgium, pp. B-260 to B-261.

English Language Abstract for DE 44 09 715.

Frey, K.H. et al., entitled "Cure Monitoring of Thermoset Coatings" Progress in Organic Coatings 27 (1996) pp. 59-66.

*Primary Examiner*—Kishor Mayekar

(57) ABSTRACT

A process for producing a multicoat system on a substrate, in which a) an electrodeposition coating film is deposited on the substrate, b) the electrodeposition coating film is predried by heating to a predrying temperature for a predetermined period, c) a coat of a surfacer is applied to the electrodeposition coating film, and d) the electrodeposition coating film and the coat of the surfacer are baked together at elevated temperatures, and in which the predrying temperature in step b) is equal to the temperature ($T_p$) or lies above the temperature ($T_p$) at which the loss factor tan δ, which is the quotient formed from the loss modulus E" and the storage modulus E', of the unbaked electrodeposition coating material shows a maximum, and the use of the resulting multicoat system.

16 Claims, No Drawings

METHOD FOR PRODUCING A MULTILAYER COATING AND THE USE THEREOF

CROSS REFERENCE TO RELATED APPLICATIONS

This application is a National Phase Application of Patent Application PCT/EP01/12102 filed on 19 Oct. 2001, which claims priority to DE 100 52 438.9, filed on 23 Oct. 2000.

FIELD OF THE INVENTION

The invention relates to a process for producing a multicoat system on an electrically conducting substrate, in which an electrodeposition coating film is deposited on the substrate, the electrodeposition coating film is predried by heating to a predrying temperature, a coat of a surfacer is applied to the electrodeposition coating film, and the electrodeposition coating film and the coat of the surfacer are baked together at elevated temperatures, and the use of the multicoat systems obtained in this way.

The invention further relates to a method of determining the predrying temperature of the electrodeposition coating material in a process of the abovementioned variety by means of dynamic mechanical thermoanalysis (DMTA). DMTA is known, for example, from the German Patent Application DE 44 09 715 A1, where it is used for quantitative description of the chemical crosslinking reactions in coating films deposited on strips of fabric having a defined profile of mechanical properties. By using electrically conductive strips of material it is also possible to deposit and investigate electrodeposition coating materials. Determination of the predrying temperature of the electrodeposition coating films by means of DMTA is not described in DE 44 09 715 A1.

BACKGROUND OF THE INVENTION

For producing multicoat systems having a primer comprising an electrodeposition coating material with a coat situated above it, the process of what is known as wet-on-wet application of electrodeposition coating material and at least one further coat is known, for example, from the patent applications EP 0 817 684 A1, EP 0 639 660 A1, EP 0 595 186 A1, EP 0 646 420 A1 or DE 41 26 476 A1. The coating materials which are applied wet-on-wet may be in liquid (aqueous, conventional or powder slurry) or powder form. The coating materials may be pigmented and unpigmented and may be used to produce surfacers or functional coats (pigmented) or clearcoats (unpigmented), but especially to produce surfacers.

During the implementation of the wet-on-wet processes, the applied electrodeposition coating film is generally predried prior to the application of the next coating material. This is generally done under conditions in which water and solvents are largely evaporated from the electrodeposition coating film. This procedure is environmentally and economically advantageous and, moreover, generally produces better-quality coatings.

Nevertheless, it is possible again and again to observe problems with the surface appearance (i.e., appearance of the overall system including clearcoat). These problems are manifested, for example, in the values of a longwave/shortwave wavescan (light reflection) which gives a value for the amount of scattered light. The flow of the coated material, as well, in many cases fails to meet requirements.

Attempts have been made to solve these problems, in a very wide variety of ways.

For example, in the process according to the German Patent Application DE 41 26 476 A1, the use of electrodeposition coating materials is restricted to those which on curing have a baking loss of less than 10%. However, this imposes severe restrictions on the user in the selection of suitable electrodeposition coating materials.

The process according to the European Patent Application EP 0 646 420 A1 uses electrodeposition coating materials and powder coating materials whose baking temperatures are harmonized with one another. Thus, the interval of the minimum baking temperature of the second coat (powder coat) should lie above the interval of the first coat (electrodeposition coat), or the intervals should overlap such that the lower limit of the interval of the minimum baking temperature of the second coat lies above the lower limit of the interval of the electrodeposition coat. In other words, the electrodeposition coating material has a baking temperature which is lower than the baking temperature of the powder coating material. Despite this adaptation of the baking temperatures, problems of appearance and of flow continue to occur. Moreover, extensive flaking may occur on stone impact.

Accordingly, the attempts to solve the problems stated have essentially concentrated on selecting only electrodeposition coating materials having a low volume shrinkage or on adapting to one another the baking temperatures of the electrodeposition coating film and the second coating film.

SUMMARY OF THE INVENTION

It is an object of the present invention to find a new process of the variety mentioned at the outset for producing multicoat systems on electrically conductive substrates which no longer has the disadvantages of the prior art but which instead, in an environmentally and economically efficient manner, produces high-quality multicoat systems which have an improved surface appearance (appearance of the overall system including clearcoat) and better flow of the coating. The improved appearance should be manifested significantly in particular in the values of a longwave/shortwave wavescan (light reflection) which gives a value for the amount of scattered light. Moreover, the antistonechip properties should be improved. A further aspect of the present invention is the use of the multicoat systems in automobile coating and in industrial coating.

This object is achieved by means of a process for producing a multicoat system on a substrate or the use of this multicoat system, in which a) an electrodeposition coating film is deposited on the substrate,
b) the electrodeposition coating film is predried by heating to a predrying temperature of the electrodeposition coating material for a predetermined period,
c) a coat of a surfacer is applied to the electrodeposition coating film, and
d) the electrodeposition coating film and the coat of the surfacer are baked together at elevated temperatures.

A feature of the process is that the predrying temperature lies at or above, preferably from 0° C. to 35° C. and more preferably from 5° C. to 25° C. above, the temperature $T_p$ at which the loss factor tan δ of the unbaked (i.e., uncrosslinked) electrodeposition coating material shows a maximum.

The recoverable energy component (elastic component) in the deformation of a viscoelastic material such as a polymer is determined by the size of the storage modulus E', whereas the energy component consumed (dissipated) in this process is described by the size of the loss modulus E". The moduli E' and E" are dependent on the rate of deformation and the temperature. The loss factor tan δ is defined as the quotient formed from the loss modulus E" and the storage modulus E'. tan δ may be determined with the aid of dynamic mechanical thermoanalysis (DMTA) and represents a measure of the relationship between the elastic and plastic properties of the electrodeposition coating film (Th. Frey, K.-H. Groβe-Brinkhause, U. Röckrath: Cure Monitoring of Thermoset Coatings, Progress in Organic Coatings 27 (1996) 59–66).

It has surprisingly been found that the achievement or exceedance of the above-mentioned temperature $T_p$ is critical to the success of wet-on-wet application and that the evaporation of water or solvents is of little or no priority. Processes whose predrying operation is aimed only at removing solvents, such as drying with predried air at reduced temperatures, for example, therefore generally give results which are much poorer.

When the predrying temperature of the invention is kept to, an improved surface appearance may be observed (appearance of the overall system including clearcoat). This is manifested, for example, in the values of a longwave/shortwave wavescan (light reflection) which gives a value for the amount of scattered light. The flow of the coating material is also improved.

In addition, it is possible to observe an improvement in the antistonechip properties. In particular, the area of flaking is smaller and there is better adhesion to the substrate.

The reasons for the decisive influence of the predrying temperature attained are unelucidated. It is possible that relaxation processes take place within the electrodeposition coating film (cf. Encyclopedia of Polymer Science and Engineering, Vol. 5, John Wiley and Sons, pages 299–329). The factor involved need not necessarily include glass transitions, since with certain electrodeposition coating materials it was possible in experiments to rule out explicitly such a glass transition within the temperature range of the predrying.

In the process of the invention, it is possible in many cases to prescribe lower predrying temperatures than in the case of the prior art. In these cases, therefore, it is not necessary to cool down the system so greatly before applying the surfacer, so simplifying the process, saving energy, and leading to lower capital costs and operating costs.

It is a particular advantage of the process of the invention that the optimum predrying temperature—irrespective of whether it is comparatively high or comparatively low—may be determined in a simple manner for a given electrodeposition coating material.

DETAILED DESCRIPTION OF THE INVENTION

The prescribed period for the implementation of predrying in step b) is typically from 1 to 60 minutes, preferably from 5 to 15 minutes. After predrying, the substrate is preferably taken back to the ambient temperature before the surfacer is applied. The time between the application of the electrodeposition coating material and the application of the surfacer is arbitrary.

In accordance with one development of the process of the invention, the coat of a surfacer applied in step c) is predried for from about 1 to 30 minutes, preferably for from 10 to 20 minutes, before the conjoint baking in step d). This predrying takes place at a temperature which is dependent on the surfacer material, so that the skilled worker is readily able to determine the optimum temperature on the basis of his or her general knowledge in the art, possibly with the aid of rangefinding tests.

The thickness of the fully cured electrodeposition coating film is preferably from 10 μm to 30 μm, with particular preference from 15 μm to 20 μm. The thickness of the fully cured surfacer coat depends on the surfacer material and is preferably from 10 μm to 60 μm.

Suitable baths for the electrodeposition coating operation are all customary anodic or cathodic electrodeposition coating baths.

These electrodeposition coating baths are aqueous coating materials having a solids content of in particular from 5 to 30% by weight.

The solids of the electrodeposition coating material comprise (A) customary and known binders which carry functional groups (a1) which are ionic or are convertible into ionic groups, and functional groups (a2) capable of chemical crosslinking, these groups being externally crosslinking and/or self-crosslinking, but especially externally crosslinking;

(B) if desired, crosslinking agents which carry complementary functional groups (b1) which are able to enter into chemical crosslinking reactions with the functional groups (a2), and which are employed mandatorily when the binders (A) are externally crosslinking; and (C) customary and known coatings additives.

Where the crosslinking agents (B) and/or their functional groups (b1) have already been incorporated into the binders (A), self-crosslinking applies.

Suitable complementary functional groups (a2) of the binders (A) are preferably thio, amino, hydroxyl, carbamate, allophanate, carboxyl and/or (meth)acrylate groups, but especially hydroxyl groups, and suitable complementary functional groups (b1) are preferably anhydride, carboxyl, epoxy, blocked isocyanate, urethane, methylol, methylol ether, siloxane, amino, hydroxyl and/or beta-hydroxyalkylamide groups, but especially blocked isocyanate groups.

Examples of suitable functional groups (a1), which are ionic or are convertible into ionic groups, of the binders (A) are (a11) functional groups which can be converted into cations by neutralizing agents and/or quaternizing agents, and/or cationic groups, or (a12) functional groups which can be converted into anions by neutralizing agents, and/or anionic groups.

The binders (A) containing functional groups (a11) are used in cathodic electrodeposition coating materials whereas the binders (A) containing functional groups (a12) are employed in anodic electrodeposition coating materials.

Examples of suitable functional groups (a11) for use in accordance with the invention that can be converted into cations by neutralizing agents and/or quaternizing agents are primary, secondary or tertiary amino groups, secondary sulfide groups or tertiary phosphine groups, especially tertiary amino groups or secondary sulfide groups.

Examples of suitable cationic groups (a11) for use in accordance with the invention are primary, secondary, tertiary or quaternary ammonium groups, tertiary sulfonium groups or quaternary phosphonium groups, preferably quaternary ammonium groups or quaternary ammonium groups, tertiary sulfonium groups, but especially quaternary ammonium groups.

Examples of suitable functional groups (a12) for use in accordance with the invention that may be converted into anions by neutralizing agents are carboxylic, sulfonic or phosphonic acid groups, especially carboxylic acid groups.

Examples of suitable anionic groups (a12) for use in accordance with the invention are carboxylate, sulfonate or phosphonate groups, especially carboxylate groups.

The selection of the groups (a11) or (a12) should be made so as to rule out the possibility of any disruptive reactions with the functional groups (a2) which are able to react with the crosslinking agents (B). The skilled worker will therefore be able to make the selection in a simple way on the basis of his or her knowledge of the art.

Examples of suitable neutralizing agents for functional groups (a11) convertible into cations are organic and inorganic acids such as sulfuric acid, hydrochloric acid, phosphoric acid, amidosulfonic acid, lactic acid, dimethylolpropionic acid, or citric acid, especially formic acid, acetic acid or lactic acid.

Examples of suitable neutralizing agents for functional groups (a12) convertible into anions are ammonia, ammonium salts, such as, for example, ammonium carbonate or ammonium hydrogen carbonate and also amines, such as, for example, trimethylamine, triethylamine, tributylamine, dimethylaniline, diethylaniline, triphenylamine, dimethylethanolamine, diethylethanolamine, methyldiethanolamine, triethanolamine and the like.

In general, the amount of neutralizing agent is chosen so that from 1 to 100 equivalents, preferably from 50 to 90 equivalents, of the functional groups (a11) or (a12) of the binder (b1) are neutralized.

Examples of suitable binders (A) for anodic electrodeposition coating materials are known from the patent DE 28 24 418 A1. They comprise, preferably, polyesters, epoxy resin esters, poly(meth)acrylates, maleate oils or polybutadiene oils having a weight average molecular weight of from 300 to 10 000 daltons and an acid number of from 35 to 300 mg KOH/g.

Examples of suitable binders (A) for cathodic electrodeposition coating materials are known from the patents EP 0 082 291 A1, EP 0 234 395 A1, EP 0 227 975 A1, EP 0 178 531 A1, EP 0 333 327, EP 0 310 971 A1, EP 0 456 270 A1, U.S. Pat. No. 3,922,253 A, EP 0 261 385 A1, EP 0 245 786 A1, EP 0 414 199 A1, EP 0 476 514 A1, EP 0 817 684 A1, EP 0 639 660 A1, EP 0 595 186 A1, DE 41 26 476 A1, WO 98/33835, DE 33 00 570 A1, DE 37 38 220 A1, DE 35 18 732 A1 or DE 196 18 379 A1.

These binders are preferably resins (A) containing primary, secondary, tertiary or quaternary amino or ammonium groups and/or tertiary sulfonium groups and having amine numbers of preferably between 20 and 250 mg KOH/g and a weight average molecular weight of preferably from 300 to 10 000 daltons. It is preferred to use amino (meth)acrylate resins, amino epoxy resins, amino epoxy resins having terminal double bonds, amino epoxy resins having primary and/or secondary hydroxyl groups, amino polyurethane resins, amino-containing polybutadiene resins, or modified epoxy resin-carbon-dioxide-amine reaction products.

Particularly preferred resins used as binders (A) are modified epoxy resins in accordance with WO 98/33835, which are obtainable by reacting an epoxy resin with a mixture of monophenols and diphenols, reacting the resulting product with a polyamine to give an amino epoxy resin, and then reacting the resulting amino epoxy resin in a further stage with an organic amine to give the modified epoxy resin (cf. WO 98/33835, page 19, line 1 to page 21, line 30).

In accordance with the invention, it is preferred to use cathodic electrodeposition coating materials, especially cathodic electrodeposition coating materials based on the above-described binders (A), and the corresponding electrodeposition coating baths.

The electrodeposition coating materials preferably comprise crosslinking agents (B).

Examples of suitable crosslinking agents (B) whose use is preferred are blocked organic polyisocyanates, especially blocked so-called paint polyisocyanates, containing blocked isocyanate groups attached to aliphatic, cycloaliphatic, araliphatic and/or aromatic moieties.

For their preparation, preference is given to using polyisocyanates having from 2 to 5 isocyanate groups per molecule and having viscosities of from 100 to 10 000, preferably from 100 to 5000 and in particular from 100 to 2000 mPa·s (at 23° C.). Moreover, the polyisocyanates may have been hydrophilically or hydrophobically modified in a customary and known manner.

Examples of suitable polyisocyanates are described, for example, in "Methoden der organischen Chemie", Houben-Weyl, Volume 14/2, 4th edition, Georg Thieme Verlag, Stuttgart 1963, pages 61 to 70, and by W. Siefken, Liebigs Annalen der Chemie, Volume 562, pages 75 to 136.

Further examples of suitable polyisocyanates are isophorone diisocyanate (i.e. 5-isocyanato-1-isocyanatomethyl-1,3,3-trimethylcyclohexane), 5-isocyanato-1-(2-isocyanatoeth-1-yl)-1,3,3-trimethylcyclohexane, 5-isocyanato-1-(3-isocyanatoeth-1-yl)-1,3,3-trimethylcyclohexane, 5-isocyanato-(4-isocyanatobut-1-yl)-1,3,3-trimethylcyclohexane, 1-isocyanato-2-(3-isocyanatoprop-1-yl)cyclohexane, 1-isocyanato-2-(3-isocyanatoeth-1-yl)cyclohexane, 1-isocyanato-2-(4-isocyanatobut-1-yl)cyclohexane, 1,2-diisocyanatocyclobutane, 1,3-diisocyanatocyclobutane, 1,2-diisocyanatocyclopentane, 1,3-diisocyanatocyclopentane, 1,2-diisocyanatocyclohexane, 1,3-diisocyanatocyclohexane, 1,4-diisocyanatocyclohexane, dicyclohexylmethane 2,4'-diisocyanate, dicyclohexylmethane 4,4'-diisocyanate, liquid dicyclohexylmethane 4,4'-diisocyanate with a trans/trans content of up to 30% by weight, preferably 25% by weight and in particular 20% by weight, obtainable by phosgenating isomer mixtures of bis(4-aminocyclohexyl)methane or by fractionally crystallizing commercially customary bis(4-isocyanatocyclohexyl)methane in accordance with the patents DE 44 14 032 A1, GB 1220717 A1, DE 16 18 795 A1 or DE 17 93 785 A1; trimethylene diisocyanate, tetramethylene diisocyanate, pentamethylene diisocyanate, hexamethylene diisocyanate, ethylethylene diisocyanate, trimethylhexane diisocyanate, heptamethylene diisocyanate or diisocyanates derived from dimeric fatty acids, as marketed under the commercial designation DDI 1410 by the company Henkel and described in the patents WO 97/49745 and WO 97/49747, especially 2-heptyl-3,4-bis(9-isocyanatononyl)-1-pentylcyclohexane, 1,2-, 1,4- or 1,3-bis(isocyanatomethyl)cyclohexane, 1,2-, 1,4- or 1,3-bis(2-isocyanatoeth-1-yl)cyclohexane, 1,3-bis-(3-isocyanatoprop-1-yl) cyclohexane or 1,2-, 1,4- or 1,3-bis(4-isocyanatobut-1-yl) cyclohexane, m-tetramethylxylylene diisocyanate (i.e. 1,3-bis(2-isocyanatoprop-2-yl)benzene or tolylene diisocyanate.

Examples of suitable polyisocyanate adducts are isocyanato-functional polyurethane prepolymers which are preparable by reacting polyols with an excess of polyisocyanates and are preferably of low viscosity. It is also possible to use polyisocyanates containing isocyanurate, biuret, allophanate, iminooxadiazinedione, urethane, urea, carbodiimide and/or uretdione groups. Polyisocyanates containing urethane groups, for example, are obtained by reacting some of the isocyanate groups with polyols, such as trimethylolpropane and glycerol, for example.

Very particular preference is given to the use of mixtures of polyisocyanate adducts containing uretdione and/or isocyanurate and/or allophanate groups and based on hexamethylene diisocyanate, as are formed by catalytic oligomerization of hexamethylene diisocyanate using appropriate catalysts. Moreover, the polyisocyanate constituent may comprise any desired mixtures of the free polyisocyanates exemplified.

Examples of suitable blocking agents for preparing the blocked polyisocyanates (B) are the blocking agents known from the U.S. Pat. No. 4,444,954 A or U.S. Pat. No. 5,972,189 A, such as i) phenols such as phenol, cresol, xylenol, nitrophenol, chlorophenol, ethylphenol, t-butylphenol, hydroxybenzoic acid, esters of this acid, or 2,5-di-tert-butyl-4-hydroxytoluene;

ii) lactams, such as ϵ-caprolactam, δ-valerolactam, γ-butyrolactam or β-propiolactam;

iii) active methylenic compounds, such as diethyl malonate, dimethyl malonate, ethyl or methyl acetoacetate, or acetylacetone;

iv) alcohols such as methanol, ethanol, n-propanol, isopropanol, n-butanol, isobutanol, t-butanol, n-amyl alcohol, t-amyl alcohol, lauryl alcohol, ethylene glycol monomethyl ether, ethylene glycol monoethyl ether, ethylene glycol monopropyl ester, ethylene glycol monobutyl ether, diethylene glycol monomethyl ether, diethylene glycol monoethyl ether, diethylene glycol monopropyl ether, diethylene glycol monobutyl ether, propylene glycol monomethyl ether, methoxymethanol, 2-(hydroxyethoxy)phenol, 2-(hydroxypropoxy)phenol, glycolic acid, glycolic esters, lactic acid, lactic esters, methylolurea, methylolmelamine, diacetone alcohol, ethylenechlorohydrin, ethylenebromohydrin, 1,3-dichloro-2-propanol, 1,4-cyclohexyldimethanol or acetocyanohydrin;

v) mercaptans such as butyl mercaptan, hexyl mercaptan, t-butyl mercaptan, t-dodecyl mercaptan, 2-mercaptobenzothiazole, thiophenol, methylthiophenol or ethylthiophenol;

vi) acid amides such as acetoanilide, acetoanisidinamide, acrylamide, methacrylamide, acetamide, stearamide or benzamide;

vii) imides such as succinimide, phthalimide or maleimide;

viii)amines such as diphenylamine, phenylnaphthylamine, xylidine, N-phenylxylidine, carbazole, aniline, naphthylamine, butylamine, dibutylamine or butylphenylamine;

ix) imidazoles such as imidazole or 2-ethylimidazole;

x) ureas such as urea, thiourea, ethyleneurea, ethylenethiourea or 1,3-diphenylurea;

xi) carbamates such as phenyl N-phenylcarbamate or 2-oxazolidone;

xii) imines such as ethyleneimine;

xiii)oximes such as acetone oxime, formaldoxime, acetaldoxime, acetoxime, methyl ethyl ketoxime, diisobutyl ketoxime, diacetyl monoxime, benzophenone oxime or chlorohexanone oximes;

xiv) salts of sulfurous acid such as sodium bisulfite or potassium bisulfite;

xv) hydroxamic esters such as benzyl methacrylohydroxamate (BMH) or allyl methacrylohydroxamate; or xvi) substituted pyrazoles, imidazoles or triazoles; and also mixtures of these blocking agents, especially dimethylpyrazole and triazoles, malonic esters and acetoacetic esters, dimethylpyrazole and succinimide, or butyl diglycol and trimethylolpropane.

Further examples of suitable crosslinking agents (B) are all known aliphatic and/or cycloaliphatic and/or aromatic polyepoxides, based for example on bisphenol A or bisphenol F. Examples of suitable polyepoxides also include the polyepoxides obtainable commercially under the designations Epikote® from Shell, Denacol® from Nagase Chemicals Ltd., Japan, such as, for example, Denacol EX-411 (pentaerythritol polyglycidyl ether), Denacol EX-321 (trimethylolpropane polyglycidyl ether), Denacol EX-512 (polyglycerol polyglycidyl ether), and Denacol EX-521 (polyglycerol polyglycidyl ether).

As crosslinking agents (B) it is also possible to use tris(alkoxycarbonylamino)triazines (TACT) of the general formula

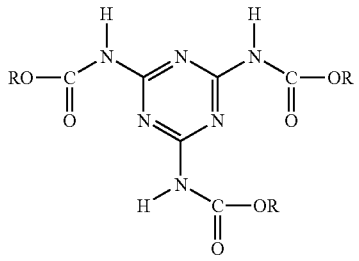

Examples of suitable tris (alkoxycarbonylamino) triazines (B) are described in the patents U.S. Pat. Nos. 4,939,213 A, U.S. Pat. No. 5,084,541 A, and EP 0 624 577 A1. Use is made in particular of the tris(methoxy-, tris(butoxy- and/or tris(2-ethylhexoxycarbonylamino)triazines.

The methyl/butyl mixed esters, the butyl 2-ethylhexyl mixed esters, and the butyl esters are of advantage. They have the advantage over the straight methyl ester of better solubility in polymer melts, and also have less of a tendency to crystallize out.

Further examples of suitable crosslinking agents (B) are amino resins, examples being melamine resins, guanamine resins, benzoguanamine resins or urea resins. Also suitable are the customary and known amino resins some of whose methylol and/or methoxymethyl groups have been defunctionalized by means of carbamate or allophanate groups. Crosslinking agents of this kind are described in the patents U.S. Pat. No. 4,710,542 A and EP 0 245 700 B1 and also in the article by B. Singh and coworkers, "Carbamylmethylated Melamines, Novel Crosslinkers for the Coatings Industry" in Advanced Organic Coatings Science and Technology Series, 1991, Volume 13, pages 193 to 207.

Further examples of suitable crosslinking agents (B) are beta-hydroxyalkylamides such as N,N,N',N'-tetrakis(2-hydroxyethyl)adipamide or N,N,N',N'-tetrakis-(2-hydroxypropyl)adipamide.

Further examples of suitable crosslinking agents (B) are compounds containing on average at least two groups capable of transesterification, examples being reaction products of malonic diesters and polyisocyanates or of esters and partial esters of polyhydric alcohols of malonic acid with monoisocyanates, as described in the European patent EP 0 596 460 A1.

The amount of the crosslinking agents (B) in the electrodeposition coating material may vary widely and is guided in particular, firstly, by the functionality of the crosslinking agents (B) and, secondly, by the number of crosslinking functional groups (a) which are present in the binder (A), and also by the target crosslinking density. The skilled worker is therefore able to determine the amount of the crosslinking agents (B) on the basis of his or her general knowledge in the art, possibly with the aid of simple rangefinding experiments. Advantageously, the crosslinking agent (B) is present in the electrodeposition coating material in an amount of from 5 to 60, with particular preference from 10 to 50, and in particular from 15 to 45% by weight, based in each case on the solids content of the coating material of the invention. It is further advisable here, to choose the amounts of crosslinking agent (B) and binder (A) such that in the electrodeposition coating material the ratio of functional groups (b1) in the crosslinking agent (B) to functional groups (a2) in the binder (A) is from 2:1 to 1:2, preferably from 1.5:1 to 1:1.5, with particular preference from 1.2:1 to 1:1.2, and in particular from 1.1:1 to 1:1.1.

The electrodeposition coating material may comprise customary coating additives (C) in effective amounts.

Examples of suitable additives (C) for pigmented electrodeposition coating materials are

- organic and/or inorganic pigments, anticorrosion pigments and/or fillers such as calcium sulfate, barium sulfate, silicates such as talc or kaolin, silicas, oxides such as aluminum hydroxide or magnesium hydroxide, nanoparticles, organic fillers such as textile fibers, cellulose fibers, polyethylene fibers, titanium dioxide, carbon black, iron oxide, zinc phosphate or lead silicate; these additives may also be incorporated into the electrodeposition coating materials of the invention by way of pigment pastes.

These additives (C) are of course not present in the unpigmented electrodeposition coating materials.

Examples of additives (C) which may be present both in pigmented and in unpigmented electrodeposition coating materials are

- free-radical scavengers;
- organic corrosion inhibitors;
- crosslinking catalysts such as organic and inorganic salts and complexes of tin, lead, antimony, bismuth, iron or manganese, preferably organic salts and complexes of bismuth and of tin, especially bismuth lactate, citrate, ethylhexanoate or dimethylol-propionate, dibutyltin oxide or dibutyltin dilaurate;
- slip additives;
- polymerization inhibitors;
- defoamers;
- emulsifiers, especially nonionic emulsifiers such as alkoxylated alkanols and polyols, phenols and alkylphenols or anionic emulsifiers such as alkali metal salts or ammonium salts of alkanecarboxylic acids, alkanesulfonic acids, and sulfo acids of alkoxylated alkanols and polyols, phenols and alkylphenols;
- wetting agents such as siloxanes, fluorine compounds, carboxylic monoesters, phosphoric esters, polyacrylic acids and their copolymers, or polyurethanes;
- adhesion promoters;
- leveling agents;
- film-forming auxiliaries such as cellulose derivatives;
- flame retardants;
- organic solvents;
- low molecular mass, oligomeric and high molecular mass reactive diluents which are able to participate in the thermal crosslinking, especially polyols such as tricyclodecanedimethanol, dendrimeric polyols, hyperbranched polyesters, polyols based on metathesis oligomers or on branched alkanes having more than eight carbon atoms in the molecule;
- anticrater agents;

Further examples of suitable coatings additives are described in the textbook "Lackadditive" [Additives for coatings] by Johan Bieleman, Wiley-VCH, Weinheim, N.Y., 1998.

The above-described crosslinking agents (B) and/or the above-described additives (C) may also be present in the surfacers described below.

In accordance with the invention, lead-free cathodic electrodeposition coating materials afford particular advantages and are therefore used with preference.

For the preparation of the electrodeposition coating film, very particular preference is given to the use of an electrodeposition coating material which comprises (A) at least one modified epoxy resin as binder, preparable by reacting epoxy resin with a mixture of monophenols and diphenols, reacting the resulting product with a polyamine to give an amino epoxy resin, and then reacting the resulting amino epoxy resin in a further stage with a further polymamine to give the modified epoxy resin; and (B) at least one blocked polyisocyanate as crosslinking agent. The predrying temperature in step b) in that case is from 70° C. to 120° C., preferably from 80° C. to 100° C.

It is a very important advantage of the process of the invention that it is possible to use even those of the above-described electrodeposition coating materials which suffer a baking loss of more than 10% on curing, without the occurrence of the problems mentioned at the outset.

Examples of suitable surfacers or antistonechip primers are known from the patents U.S. Pat. No. 4,537,926 A1, EP 0 529 335 A1, EP 0 595 186 A1, EP 0 639 660 A1, DE 44 38 504 A1, DE 43 37 961 A1, WO 89/10387, U.S. Pat. Nos. 4,450,200 A1, 4,614,683 A1, WO 94/26827 or EP 0 788 523 B1. The surfacers in this case may be present as conventional—i.e., solventborne—or as aqueous coating materials. It is also possible to use powder coating materials or powder slurry coating materials.

Preference is given to the use of aqueous surfacers.

It is preferred to use aqueous surfacers comprising as binder a water dilutable polyurethane resin. Particular preference is given to aqueous surfacers based on water dilutable polyurethane resins obtainable by reacting with one another polyester polyols and/or polyether polyols, polyisocyanates, compounds containing at least one isocyanate-reactive group and at least one (potentially) anionic group in the molecule, and also, if desired, compounds containing hydroxyl and/or amino groups. To prepare the surfacer, the polyurethane resin is neutralized at least partly and dispersed in water. The dispersion is then made up with pigments and crosslinking agents (cf., for example, the European patent EP 0 788 523 B1, page 5, lines 1 to 29).

The function of the surfacer or of the coating produced from it is to even out disruptive unevennesses (in the micrometer range) on the surface of a substrate, so that the surface of the substrate need not be subjected to a leveling pretreatment prior to the application of a coating. This is also done using the comparatively high coat thickness of the surfacer. It additionally serves to absorb and dissipate mechanical energy, as occurs on stone impact.

The multicoat system produced by the process of the invention may be used per se (2-coat system) for the abovementioned end uses. However, it may also be overcoated with a clearcoat or solid-color topcoat, giving a 3-coat system which offers an economical alternative to comparatively expensive coatings. For demanding applications where a particularly good appearance is critical, the multicoat system produced by the process of the invention may further be coated with a color and/or effect basecoat/clearcoat system, preferably by the wet-on-wet technique (4-coat system).

These processes for producing multicoat systems are being used increasingly in industrial coating for articles of all types in industrial and private use. Examples of such articles are radiators, wheelrims or hubcaps. However, they may also be used to coat automobile bodies.

The invention additionally relates to a method of determining the predrying temperature of the electrodeposition coating material in a process for producing a multicoat system of the type specified at the outset. In the method, a determination is made of the temperature $T_p$ at which a viscoelastic property of the as yet unbaked electrodeposition coating material exhibits an extreme value, and the predrying temperature is chosen to be the same as or above, preferably from 0° C. to 35° C. and more preferably from 5° C. to 25° C. above, this temperature $T_p$.

The finding underlying this method is that the primary factor in the predrying of an electrodeposition coating material in the course of the wet-on-wet application of an electrodeposition coating material and a surfacer is not the evaporation of the solvents, but instead that it is important to exceed the temperature at which internal changes of the electrodeposition coating material take place which manifest themselves in an extreme value of a viscoelastic property.

The viscoelastic property of the electrodeposition coating material that is considered in this case is the loss factor tan δ. An improvement in the coating result at predrying temperatures above the maximum of the loss factor tan δ has been demonstrated in numerous experiments.

The DMTA is a widely known measurement method for determining the viscoelastic properties of coatings and is described, for example, in Murayama, T., Dynamic Mechanical Analysis of Polymeric Materials, Elsevier, N.Y., 1978, pages 299 to 329 and Loren W. Hill, Journal of Coatings Technology, Vol. 64, No. 808, May 1992, pages 31 to 33. The process conditions during the measurement of tan δ by means of DMTA are described in detail by Th. Frey, K. -H. Groβe-Brinkhaus, U. Röckrath, in Cure Monitoring of Thermoset Coatings, Progress In Organic Coatings 27 (1996) 59–66, or in DE 44 09 715 A1.

As well as in DMTA, such a signal may also be found in the course of viscosity measurements of wet cathodic electrodeposition coating films and the corresponding evaluation in accordance with tan δ=G"/G' (cf. cf. T. Dirking, K. -H. Groβe-Brinkhaus, Rheologische Charakterisierung von Elektrotauchlacken während des Einbrennvorgangs: Korrelation von Viskositätswerten mit Kantenschutzergebnissen [Rheological characterization of electrodeposition coating materials during the baking procedure: correlation of viscosity values with edge protection results], Fatipec XXIII, 1996, Brussels, Belgium, pages B-260 to B-271). Since these measurements are generally taken after predrying at from 100° C. to 110° C., it is evident here too that this is a characteristic of the cathodic electrodeposition coating system.

The particular advantages of the process of the invention are not, however, restricted to the combination of electrodeposition coating and surfacer coating but instead extend to the coatings lying above them as well. Accordingly, the clearcoats, solid-color topcoats or color and/or effect basecoat/clearcoat systems produced on top of them have an improved surface appearance (appearance of the overall system including clearcoat). This is manifested, for example, in the values of a longwave/shortwave wavescan (light reflection) which gives a value for the amount of scattered light. The flow of the coating material is also improved.

Moreover, an improvement may be observed in the anti-stonechip properties. In particular, the flaking area is smaller and there is better adhesion to the substrate.

Inventive Examples

1. Preparation of a Crosslinking Agent (C1) for an Electrodeposition Coating Material A reactor is charged under nitrogen with 10 462 parts of isomers and oligomers of higher functionality based on 4,4'-diphenylmethane diisocyanate, having an NCO equivalent weight of 135 g/eq (Lupranat® M20S from BASF AG; NCO functionality approx. 2.7; 2,2'- and 2,4'-diphenylmethane diisocyanate content less than 5%). 20 parts of dibutyltin dilaurate are added and 9626 parts of butyl diglycol are added dropwise at a rate such that the product temperature remains below 60° C. Following the addition, the temperature is held at 60° C. for a further 60 minutes and an NCO equivalent weight of 1120 g/eq is measured (based on solid fractions). After the product has been diluted in 7737 parts of methyl isobutyl ketone, and 24 parts of dibutyltin dilaurate have been added, 867 parts of melted trimethylolpropane are added at a rate such that the product temperature does not exceed 100° C. Following the addition, reaction is continued for 60 minutes. The mixture is cooled to 65° C. and simultaneously diluted with 963 parts of n-butanol and 300 parts of methyl isobutyl ketone. The solids content is 70.1% (1 h at 130° C.).

2. Preparation of a Precursor (AC1) for an Electrodeposition Coating Binder

The water of reaction is removed at from 110° C. to 140° C. from a 70% strength solution of diethylenetriamine in methyl isobutyl ketone. The solution is subsequently diluted with methyl isobutyl ketone until it has an amine equivalent weight of 131 g/eq.

3. Preparation of an Aqueous Electrodeposition Coating Binder Dispersion (D1)

In a reactor fitted with a stirrer, reflux condenser, internal thermometer and inert gas inlet, 6150 parts of epoxy resin based on bisphenol A, having an epoxy equivalent weight (EEW) of 188, are heated to 125° C. under nitrogen together with 1400 parts of bisphenol A, 355 parts of dodecylphenol, 470 parts of p-cresol and 441 parts of xylene, and the mixture is stirred for 10 minutes. It is subsequently heated to 130° C. and 23 parts of N,N-dilmethylbenzylamine are added. The reaction mixture is held at this temperature until the EEW has reached a value of 880 g/eq.

Then a mixture of 7097 parts of the crosslinking agent C1 and 90 parts of the additive K 2000 (polyether from Byk Chemie, Germany) is added and the mixture is held at 100° C. Half an hour later, 211 parts of butyl glycol and 1210 parts of isobutanol are added.

Immediately thereafter, a mixture of 467 parts of the precursor AC1 (from step 2) and 520 parts of methylethanolamine is introduced into the reactor and the mixture is conditioned to 100° C. After a further half-hour, the temperature is raised to 105° C. and 159 parts of N,N-dimethylaminopropylamine are added.

75 minutes after the addition of the amine, 903 parts of Plastilit® 3060 (propylene glycol compound from BASF AG) are added and the mixture is diluted with 522 parts of propylene glycol phenyl ether (mixture of 1-phenoxy-2-propanol and 2-phenoxy-1-propanol, from BASF AG) and at the same time cooled rapidly to 95° C.

After 10 minutes, 14 821 parts of the reaction mixture are transferred to a dispersing vessel. There, 474 parts of lactic acid (88% strength in water), dissolved in 7061 parts of deionized water, are added with stirring. The mixture is subsequently homogenized for 20 minutes before being diluted further with an additional 12 600 parts of deionized water in small portions.

The volatile solvents are removed by distillation under reduced pressure and then replaced by an equal volume of deionized water.

The dispersion D1 possesses the following characteristics:

| | |
|---|---|
| Solids content: | 33.8% (1 h at 130° C.)<br>29.9% (0.5 h at 180° C.) |
| Base content: | 0.71 milliequivalents/g solids (130° C.) |
| Acid content: | 0.36 milliequivalents/g solids (130° C.) |
| pH: | 6.3 |
| Particle size: | 116 nm (mass average from photon correlation spectroscopy) |

4. Preparation of the Aqueous Electrodeposition Binder Dispersion (D2)

The binder dispersion D2 is prepared in exactly the same way as the binder dispersion D1 except that, immediately after the dilution with propylene glycol phenyl ether, 378 parts of K-KAT 348 (bismuth 2-ethylhexanoate from King Industries, USA) are admixed to the organic stage with stirring. After cooling, 14 821 parts of the reaction mixture are dispersed in exactly the same way as dispersion D1.

The dispersion D2 possesses the following characteristics:

| | |
|---|---|
| Solids content: | 33.9% (1 h at 130° C.)<br>30.1% (0.5 h at 180° C.) |
| Base content: | 0.74 milliequivalents/g solids (130° C.) |
| Acid content: | 0.48 milliequivalents/g solids (130° C.) |
| pH: | 5.9 |
| Particle size: | 189 nm (mass average from photon correlation spectroscopy) |

5. Preparation of a Crosslinking Agent (C2) for an Electrodeposition Coating Material (in Analogy to WO 98/33835)

A reactor is charged under nitrogen with 1084 g parts of isomers and oligomers of higher functionality based on 4,4'-diphenylmethane diisocyanate, having an NCO equivalent weight of 135 g/eq (Lupranat® M20S from BASF AG; NCO functionality approx. 2.7; 2,2'- and 2,4'-diphenylmethane diisocyanate content less than 5%). 2 g of dibutyltin dilaurate are added and 1314 g of butyl diglycol are added dropwise at a rate such that the product temperature remains below 70° C. It may be necessary to carry out cooling. After the end of addition, the temperature is held at 70° C. for a further 120 minutes.

The solids content is >97% (1 h at 130° C.).

6. Preparation of the Aqueous Electrodeposition Coating Binder Dispersion (D3) (in Analogy to WO 98/33835, Example 2.3)

In a reactor fitted with a stirrer, reflux condenser, internal thermometer and inert gas inlet, 1128 parts of epoxy resin based on bisphenol A, having an epoxy equivalent weight (EEW) of 188, 94 parts by weight of phenol and 228 parts of bisphenol A are heated to 127° C. under nitrogen. With stirring, 1.5 parts of triphenylphosphine are added, whereupon an exothermic reaction occurs and the temperature rises to 160° C. The mixture is allowed to cool again to 130° C. and the epoxide content is monitored. The EEW of 532 indicates that >98 of the phenolic OH groups have reacted. The subsequent addition of 157 parts of Pluriol P 600 (polypropylene glycol MW 600, BASF) is accompanied by cooling. When the mixture reaches 95° C., 115.5 parts of diethanolamine are added, whereupon an exothermic reaction occurs and the temperature rises to 115° C. After a further 40 minutes at 115° C., 61.2 parts of N,N-dimethylaminopropylamine are added. Following a short exothermic period ($T_{max}$ 140° C.), the mixture is left to react further for 2 hours at 130° C. until the viscosity remains constant. Then 97.6 parts of butyl glycol and 812 parts of the crosslinking agent (C2) are added, with simultaneous cooling, and the mixture is discharged at 105° C.

2400 parts of the still-hot mixture are dispersed immediately with intensive stirring in a mixture of 2173 parts of fully deionized water and 49.3 parts of glacial acetic acid. 53 parts of K-KAT 348 (bismuth 2-ethylhexanoate from King Industries, USA) are added to this mixture, and the resulting mixture is homogenized briefly and then diluted with a further 752 parts of fully deionized water, after which it is filtered through plate filter K 900 (from Seitz). The dispersion D3 has the following characteristics:

| | |
|---|---|
| Solids content: | 45% (1 h at 130° C.)<br>40.1% (0.5 h at 180° C.) |
| Base content: | 0.82 milliequivalents/g solids (130° C.) |
| Acid content: | 0.42 milliequivalents/g solids (130° C.) |
| pH: | 6.1 |
| Particle size: | 129 nm (mass average from photon correlation spectroscopy) |

7. Preparation of an Epoxy-amine Adduct Solution that is Used (E1)

In accordance with Example 1.3 of EP 0 505 445 B1, an organic-aqueous solution of an epoxy-amine adduct is prepared by reacting, in a first stage, 2598 parts of bisphenol A diglycidyl ether (epoxy equivalent weight (EEW): 188 g/eq), 787 parts of bisphenol A, 603 nparts of dodecylphenol and 206 parts of butyl glycol in the presence of 4 parts of triphenylphosphine at 130° C. to an EEW of 865 g/eq. Cooling is accompanied by dilution with 849 parts of butyl glycol and 1534 parts of D.E.R.®732 (polypropylene glycol glycidyl ether from DOW Chemical), and reaction is continued at 90° C. with 266 parts of 2,2'-aminoethoxyethanol and 212 parts of N,N-dimethylaminopropylamine. After 2 hours, the viscosity of the resin solution is constant (5.3 dPa·s; 40% strength in Solvenon® PM (methoxypropanol from BASF AG); cone and plate viscometer at 23° C.). The product is diluted with 1512 parts of butyl glycol and the base groups are partly neutralized with 201 parts of glacial acetic acid; the product is diluted further with 1228 parts of deionized water and discharged.

This gives a 60% strength aqueous-organic resin solution whose 10% dilution has a pH of 6.0.

8. Preparation of a Pigment Paste

First of all, a premix is formed from 277 parts of water and 250 parts of the epoxy-amine adduct described in step 5. Then 5 parts of carbon black, 60 parts of Extender ASP 200, 351 parts of titanium dioxide TI-PURE® R 900 (from DuPont) and 54 parts of dibutyltin oxide (Fascat 4203 from Elf-Atochem) are added and mixed for 30 minutes under a high-speed dissolver stirring mechanism. The mixture is subsequently dispersed in a stirred laboratory mill for from 1 to 1.5 h to a Hegman fineness of 12 μm and is adjusted if necessary to the desired processing viscosity using further water. Solids content: 60% (0.5 h, 180° C.)

9. Preparation of the Electrodeposition Coating Materials

The electrodeposition coating binder dispersions D1–D3 and, if appropriate, the pigment paste (step 8) were used to prepare the following electrodeposition coating materials:

| | ETL1 | ETL2 | ETL3 |
|---|---|---|---|
| Dispersion D1 | 2771 | — | — |
| Dispersion D2 | — | 2492 | — |
| Dispersion D3 | — | — | 1871 |
| Pigment paste | 313 | | |
| DI water | 1916 | 2508 | 3129 |

The electrodeposition coating materials obtained in this way have a solids content of approximately 20% in the case of the pigmented system ETL1 and 15% in the case of the clearcoats ETL2–3.

The application conditions (deposition voltage, deposition temperature) were chosen so that, following bath aging of a minimum of 24 h and baking (15 minutes at a panel temperature of 180° C.), smooth films with a thickness of approximately 20 μm were obtained on steel panels (e.g., Bo 26 W 42 OC) which had not been given a passivating rinse.

The process conditions for the determination of $T_p$ of the electrodeposition coating materials by means of DMTA were as follows (cf. Th. Frey, K. -H. Groβe-Brinkhaus, U. Röckrath, Cure Monitoring of Thermoset Coatings, Progress in Organic Coatings 27 (1996) 59–66, or in DE 44 09 715 A1):

| | |
|---|---|
| 1. Preparation: | deposition of electrodeposition coating material on a carbon fiber mesh (Sigratex from Sigri) |
| 2. Instrument: | DMA MK IV (from Rheometric Scientific) |
| 3. Conditions: | tensile mode, amplitude 0.2%, frequency 1 Hz |
| 4. Temperature ramp: | 1° C./min from room temperature to 200° C. |

In the DMTA, a sudden sharp change in the storage modulus E' and the loss factor tan δ occurred at about 145° C., and can be attributed to the beginning of the crosslinking reaction. It was also possible to see that below this crosslinking temperature the loss factor tan δ shows a maximum (peak) at a temperature $T_p$ of about 90° C. As was found by further investigations, this maximum was not attributable to a glass transition in the cathodic electrodeposition coating material under consideration.

During a repeat scan of the temperature range from 20° C. to 100° C. with a ten-minute holding time at 100° C. it was found that, even after several runthroughs a peak at about 80° C. in the loss factor tan δ occurred in each case. Only a slight shift in the signal toward higher temperatures during the temperature cycles was observed, which pointed to evaporation or drying. The peak itself, however, was retained, so that the basis for this signal could not lie in drying phenomena.

For the inventive experiments, the panels were not baked but instead only predried in a forced air oven for 10 minutes at 80° C. or at 100° C. The temperatures were chosen because the electrodeposition coating films deposited, as described above, had a maximum of a loss factor tan δ at $T_p$>80° C.

10. Preparation of Water Dilutable Polyurethane Resins

The preparation is as in Example 1.1 of EP 0 788 523 B1.

11. Preparation of Aqueous Surfacers

The preparation is as in Example 2.a of EP 0 788 523 B1.

The aqueous coating material (step 11) is applied with a dry film thickness of 19 μm to the predried cathodic electrodeposition coatings and is itself predried at 70° C. Subsequently, cathodic electrodeposition coating and the aqueous coating material are baked together for 15 minutes at a panel temperature of 180° C.

For further tests (especially stonechip testing), the panels are overcoated with a commercially customary white basecoat material having a dry film thickness of 18 μm and with a commercially customary two-component clearcoat material having a film thickness of 35–40 μm. These films are baked at 130° C. for 30 minutes.

In order to determine the overall appearance, a black basecoat material with a film thickness of 14 μm is used instead of the white basecoat material.

The test results of the individual coating systems, as a function of the drying conditions in particular, are collated in the tables below.

TABLE 1

Technological testing

Test system: Cathodic electrodeposition coating wet-on-wet with aqueous surfacer Application method:

A. Predrying of cathodic electrodeposition coating at 80° C.,

B. Predrying of cathodic electrodeposition coating at 100° C., then conjoint baking for 15' at 180° C. (panel temp.) and white topcoat system.

| | ETL1 $T_p$: 89° C. | ETL1 | ETL2 $T_p$: 86° C. | ETL2 | ETL3 $T_p$: 82° C. | ETL3 |
|---|---|---|---|---|---|---|
| Application | A | B | A | B | A | B |
| VDA stone chipping[a)] | 2 | 1–2 | 1–2 | 1–2 | 2 | 1–2 |
| MB ball bombardment flaking[b)] | 7 | 6 | 9 | 5 | 40 | 5.5 |
| MB ball bombardment degree of rusting[b)] | 3 | 1 | 4 | 2 | 5 | 1 |

[a)]VDA stonechipping:
Multiple stonechip test in accordance with VDA [German automakers association]
test sheet: best score = 0, worst score = 5
[b)]MB ball bombardment test:
Single impact testing in accordance with DaimlerChrysler specification LPV 5200.40701
Flaking: instances of flaking, in $mm^2$
Degree of rusting: visual evaluation of the damage at the area of flaking; best score = 0, worst score = 5

The results of Table 1 underscore the significant improvement which occurs in the stonechip resistance when the electrodeposition coating films are predried above the temperature $T_p$.

TABLE 2

Effect of application on the surface appearance

Test system: Cathodic electrodeposition coating wet-on-wet with aqueous coating material Application method:

A. Predrying of cathodic electrodeposition coating at 80° C.,

B. Predrying of cathodic electrodeposition coating at 100° C., then conjoint baking for 15' at 180° C. (panel temp.) and black topcoat system.

| | ETL1 | ETL1 | ETL2 | ETL2 | ETL3 | ETL3 |
|---|---|---|---|---|---|---|
| Application | A | B | A | B | A | B |
| Wavescan Lw[c)] | 5 | 4 | 7.4 | 3.2 | 17 | 3.0 |
| Wavescan Sw[c)] | 42 | 28.1 | 35 | 22.2 | 60 | 28.7 |

[c)]Wavescan:
Measurement of the waviness of the painted surface Instrument: "wavescan plus" from Byk-Gardner Longwave characteristics (Lw, longwave) = structures > 0.6 mm Shortwave characteristics (Sw, shortwave) = structures < 0.6 mm Scale for Lw, Sw: 0 to 99, with 0 denoting the best result The results of Table 2 underscore the significant improvement which occurs in the appearance when the electrodeposition coating films are predried above the temperature $T_p$.

What is claimed is:

1. A process for producing a multicoat system on a substrate comprising a) depositing an electrodeposition coating film on the substrate, b) predrying the electrodeposition coating film by heating to a predrying temperature for a predetermined period, c) applying a coat of a surfacer to the electrodeposition coating film, and d) baking the electrodeposition coating film and the coat of the surfacer together at elevated temperatures, wherein the predrying temperature in step b) is from 0° C. to 35° C. above a temperature ($T_p$) at which a loss factor tan δ, which is the quotient formed from a loss module E" and a storage modulus E', of the unbaked electrodeposition coating film shows a maximum.

2. The process of claim 1, wherein the electrodeposition coating film is prepared using an electrodeposition coating material comprising (A) a binder comprising at least one modified epoxy resin, wherein the modified epoxy resin comprises a reaction product of an amino epoxy resin and an organic amine, wherein the amino epoxy resin comprises a reaction product of a polyamine and an epoxy resin reaction product, wherein the epoxy resin reaction product comprises a reaction product of an epoxy resin and a mixture of monophenols and diphenols; and (B) a crosslinking agent comprising at least one blocked polyisocyanate.

3. The process of claim 2, wherein the predrying temperature in step b) is from 70° C. to 120° C.

4. The process of claim 1, wherein the period of predrying in step b) is from 1 to 60 minutes.

5. The process of claim 1, wherein the thickness of the baked electrodeposition coating film is from 10 μm to 30 μm.

6. The process of claim 1, wherein the thickness of the coat of the surfacer after baking is from 10 μm to 60 μm.

7. The process of claim 1, wherein the substrate is cooled to ambient temperature before application of the coat of the surfacer.

8. The process of claim 1, wherein the electrodeposition coating film is a cathodically depositable coating film.

9. The process of claim 1, wherein the surfacer is an aqueous coating material.

10. The process of claim 9, wherein the surfacer comprises a binder comprising a water-soluble polyurethane resin.

11. The process of claim 1, wherein one of i) the coat of the surfacer forms the topmost coat of the multicoat system (2-coat system), ii) the coat of the surfacer is overcoated with a clearcoat or solid-color topcoat (3-coat system), and iii) the coat of the surfacer is overcoated with a color and/or effect basecoat/clearcoat system (4-coat system).

12. The process of claim 1, wherein the multicoat system is one of an automobile coating and an industrial coating.

13. The process of claim 12, wherein the industrial coating is one of a radiator coating, a wheel rim coating, and a hubcap coating.

14. A method of determining a predrying temperature of an electrodeposition coating material in a process for producing a multicoat system comprising the steps of a) depositing an electrodeposition coating film on a substrate, b) predrying the electrodeposition coating film by heating at a predrying temperature for a prescribed period, c) applying a coat of a surfacer to the electrodeposition coating film, and d) conjointly baking the electrodeposition coating film and the coat of the surfacer at elevated temperatures, wherein a temperature ($T_p$) is determined at which a loss factor tan δ of the electrodeposition coating film, which is a quotient formed from a loss modulus E" and a storage modulus E', in the as yet unbaked state has an extreme value, and in that the predrying temperature is chosen to be equal to or from 0° C. to 35° C. above the temperature ($T_p$).

15. The method of claim 14, wherein the predrying temperature is chosen to be 5° C. to 25° C. above the temperature ($T_p$) at which the loss factor tan δ of the electrodeposition coating film in the as yet unbaked state has an extreme value.

16. The method of claim 14, wherein the loss factor tan δ is determined with the aid of dynamic mechanical thermoanalysis (DMTA).

* * * * *